United States Patent [19]

Bauer

[11] 4,267,650

[45] May 19, 1981

[54] SHOE WITH REMOVABLE OUTSOLE

[76] Inventor: Peter Bauer, 6033 Hazelwood La., Bellevue, Wash. 98006

[21] Appl. No.: 61,924

[22] Filed: Jul. 30, 1979

[51] Int. Cl.[3] ..... A43B 3/24; A43B 9/10

[52] U.S. Cl. ..... 36/101; 36/15

[58] Field of Search ..... 36/100, 101, 15, 42, 36/36 R, 36 A, 36 B, 36 C, 41

[56] References Cited

U.S. PATENT DOCUMENTS

| | | | |
|---|---|---|---|
| 2,178,025 | 10/1939 | Richter | 36/101 |
| 3,686,779 | 8/1972 | Sachs | 36/101 |
| 4,062,132 | 12/1977 | Kimaszewski | 36/100 |

FOREIGN PATENT DOCUMENTS

| | | | |
|---|---|---|---|
| 2217397 | 11/1972 | Fed. Rep. of Germany | 36/101 |

*Primary Examiner*—Patrick D. Lawson

[57] ABSTRACT

Athletic shoes with removable outsoles are disclosed. Each upper is designed to fit an individual foot and ankle of a particular wearer and such upper is provided with an insole securely and permanently connected therewith. Each insole terminates along its peripheral margin with one part of a bead-and-recess mechanically detachable locking member. A removable outsole is provided with a surface contacting tread which is selected to not only best match the surface of a particular sports area but also the condition of such surface at a particular time of use. A flexible member is permanently connected with the outsole and terminates along its peripheral margin with the other part of the mechanical locking member. The outsole and the insole are further connected together by mating Velcro members, tongues and grooves carried by the outsole and insole in paired relations, and other interlocking means.

6 Claims, 5 Drawing Figures

Fig. 3
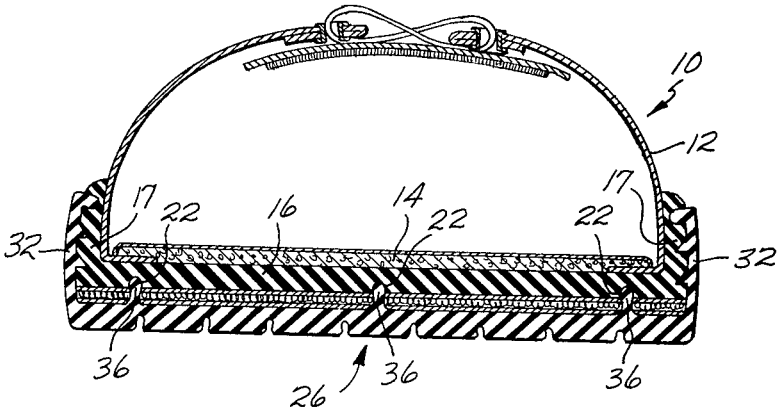
Fig. 4
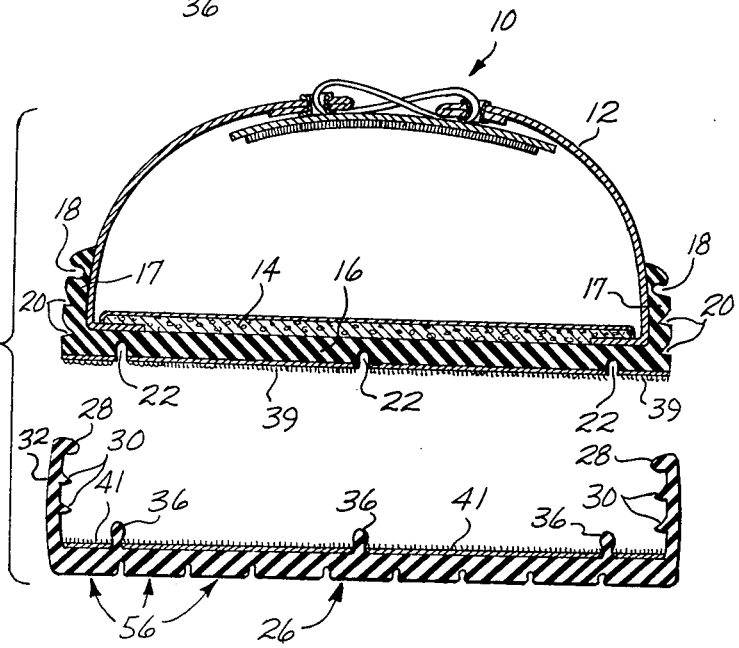
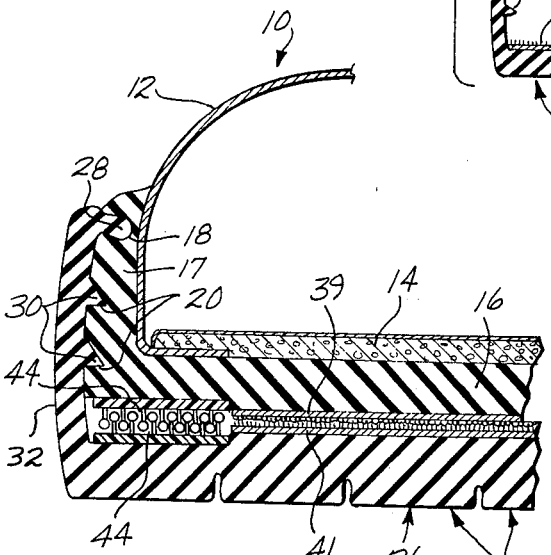
Fig. 5

SHOE WITH REMOVABLE OUTSOLE

BACKGROUND OF THE INVENTION

Athletic shoes are expensive as they must be made of excellent materials by skilled craftsmen, must be made of superior materials and should be well fitted to withstand the extreme pressures and abuses which they encounter as athletes wearing them attempt superior feats of physical prowess. Also, the surfaces on which sporting contests are conducted vary from contest to contest, from one field to another, and from day to day. For example, as to one sport such as foot ball, we may have natural grass, various kinds of artificial grass or rugs, and various kinds of soil. In addition, the weather condition may be dry and sunny, raining, sleeting, or freezing resulting in a fast, dry surface, a soft surface, a muddy surface, a slick surface, a frozen surface and combinations thereof. To permit best athletic performances on such field conditions, the shoe outsoles must have a tread best suited to the particular field surface and the condition thereof at the time of use and also have an upper well fitted to the athlete's foot and ankle. The need for a replacement or removable outsole with a tread thereon best suited to meet the particular surface conditions of the playing field and on a particular day has long been acknowledged but to provide the same with a sturdy and reliable shoe fitted to the extremes which may be encountered in athletic endeavors has been wanting.

A sample of the endeavors which might be used to satisfy the long-felt need in this art, and the most pertinent prior art known to applicant are the following United States Letters Patent:

| PATENTEE | PATENT NUMBER | ISSUE DATE |
|---|---|---|
| M. C. Clark | 980,173 | Dec. 27, 1910 |
| M. Rasmussen | 1,051,448 | Jan. 28, 1913 |
| F. Victor | 1,318,247 | Oct. 7, 1919 |
| W. M. Jessup | 1,341,323 | May 25, 1920 |
| A. Siekacz | 1,773,242 | Aug. 19, 1930 |
| E. Richter | 2,178,025 | Oct. 31, 1939 |
| E. C. Heilhecker | 2,183,277 | Dec. 12, 1939 |
| J. Fein | 2,200,080 | May 7, 1940 |
| S. H. Geffner | 2,205,091 | June 18, 1940 |
| E. Danielius | 2,552,943 | May 15, 1951 |
| W. Epsztejn | 2,528,951 | Nov. 7, 1950 |
| M. Sabbagh | 2,664,650 | Jan. 5, 1954 |
| W. C. C. Burton, Jr. | 2,839,845 | June 24, 1958 |
| C. B. Reinhart | 3,012,340 | Dec. 12, 1961 |
| R. T. Kauffman et al | 3,019,534 | Feb. 6, 1962 |
| A. Herschdorf | 3,083,476 | April 2, 1963 |
| Claude-Roger Isman | 3,878,626 | Apr. 22, 1975 |

In general such prior art patents failed to disclose shoes with removable outsoles which would stand up under the rigors and pressures of highly competitive athletic endeavors and which would provide desirable engagement with all surface conditions of the playing field.

BRIEF DESCRIPTION OF THE INVENTION

The present invention provides for the use of a shoe upper tailored to the individual measurements and peculiarities of the feet and ankles of a particular person. Such uppers are each permanently connected with an insole and each insole terminates along its peripheral margins with one part of a bead-and-recess mechanical locking means. A removable sole is provided for each shoe. Each outsole carries a flexible member which terminates along its peripheral margin with the other part of the bead-and-recess mechanical locking means. Additional releasable locking means between the outsole and the shoe upper include mated members carried by the outsole and the insole of the shoe upper, such as Velcro members, longitudinal and crosswise tongues and grooves, and intermeshing pin mechanical binders at the toe and heel portions. A plurality of outsoles are provided for each set of uppers and each of such outsoles is provided with a tread adapted to a particular or conditions of the field and for a particular athletic event on such field, as jogging, football, baseball, basketball, soccer, tennis, track and field events, boxing, and golf, to name a few. Also, to indicate a few of the surfaces that may be involved, they include plain surfaces, steel spikes, cleates, studs, ribs, ridges, and many others and combinations thereof.

Objects of my invention include: the provision of a surface bottom on the removable outsoles of athletic shoes which best meets the requirements of a particular condition of the athletic field on a particular day; a shoe upper tailored to the feet and ankles of a particular athlete; and detachable connecting means between the two which is adequate and certain to stand up under the grueling tests of competitive athletic endeavors in vigorous contact and other sporting endeavors.

Further objects and advantages of my invention will become explicit and implicit to one skilled in the art to which this invention pertains upon consideration of the following detailed description.

DESCRIPTION OF THE DRAWINGS

A more complete understanding of my invention may be had by reference to the accompanying drawings illustrating preferred forms of embodiment of my invention in which like reference numerals refer to like parts throughout the several figures and in which:

FIG. 3 is a sectional view taken substantially on broken line 3—3 of FIG. 1;

FIG. 4 is an exploded sectional view showing the two parts of FIG. 3 separated; and FIG. 5 is a fragmentary sectional view taken substantially on broken line 5—5 of FIG. 1.

DESCRIPTION OF THE PREFERRED EMBODIMENTS

Figure 1:
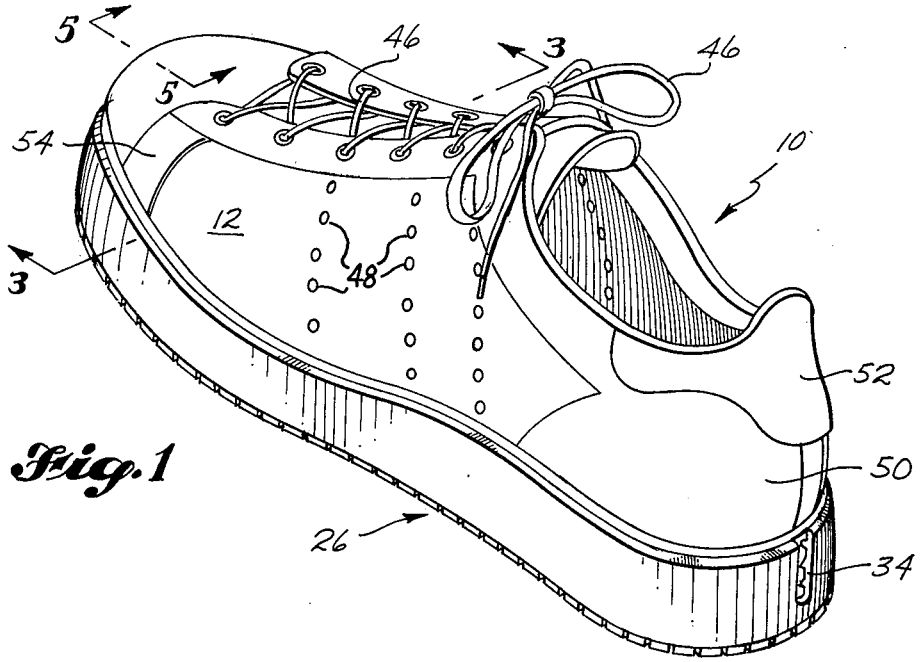
FIG. 1 is a perspective view of a sport shoe having a low-cut upper connected with a detachable or removable outsole embodying my invention.

An upper shoe part, generally designated as 10, is preferably custom tailored so that a pair thereof adequately fit the feet and ankles of a particular wearer. As many types of treads may be carried by a single set of uppers 10 to meet conditions required by a particular field or track and on a particular condition thereof on a particular day, it is felt that such custom tailoring of uppers 10 is warranted and is highly recommended.

The upper 10 includes surface portion 12, padding 14, and insole 16, At its marginal portions, insole 16 extends upwardly and continuously around the upper and terminates in vertical strips 17, which form one part of a mechanical locking member. Preferably, the recess part of such locking member is carried by such strip part 17 of insole 16 and comprises a plurality of recesses 18 and 20 (best shown in FIGS. 4 and 5). The upper recess 18 is rounded in section and the lower recesses 20 are angular, being formed by two intersecting planes, and with the lowermost thereof being horizontal.

Figure 2:
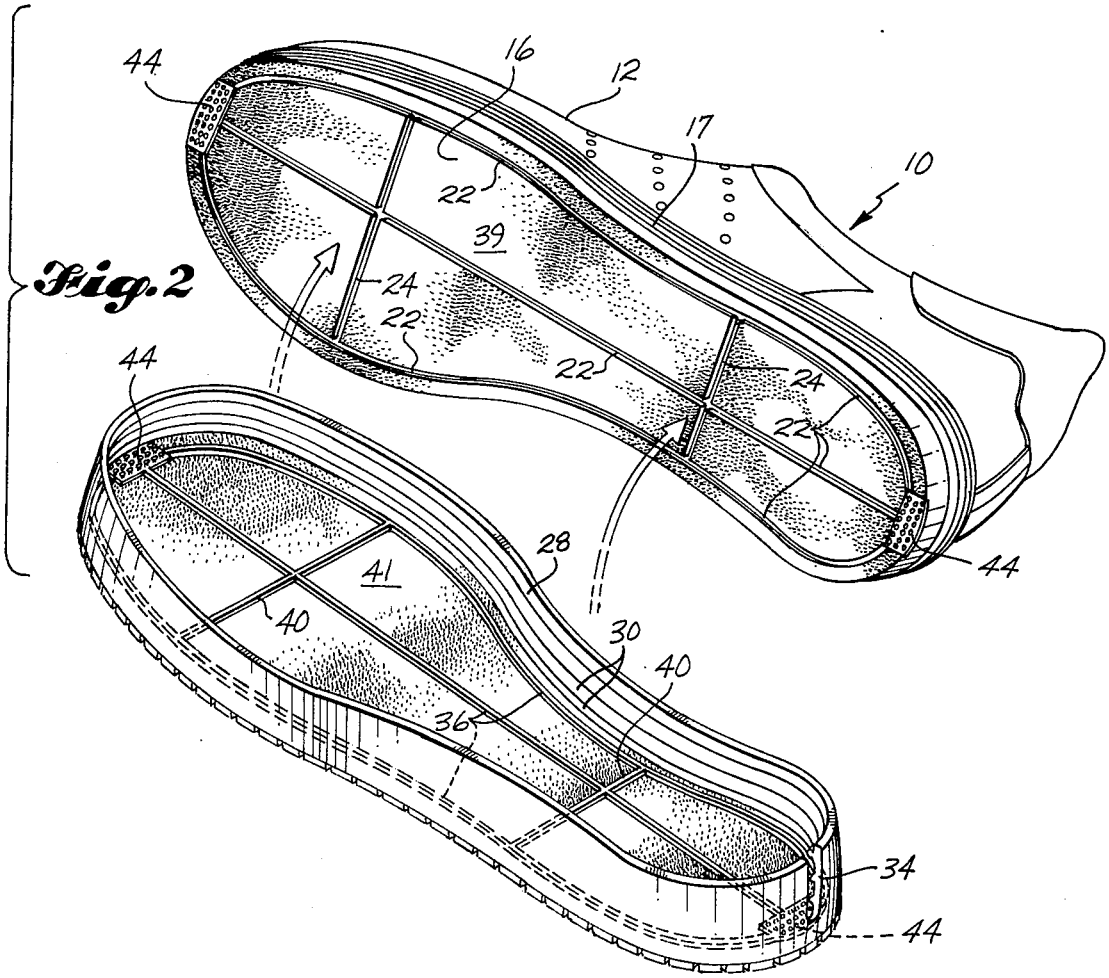
FIG. 2 is an exploded perspective view showing the upper removed from the lower or outsole.

The lower surface of the insole 16 is preferably provided (FIG. 2) with a plurality of longitudinally extending grooves 22 and a plurality of crosswise extending grooves 24. The upper terminal portions of the grooves 22 and 24 (FIGS. 3 and 4) are preferably circular in section.

The outsole 26 (FIG. 4) carries the remaining part of the bead-and-recess locking mechanism, and preferably beads 28 and 30 are carried by upstanding, flexible, marginal strips 32 of outsole 26. The bead 28 may be urged into and will snugly fit in the recess 18 carried by the strip 17. Also, beads 30 have inclined upper surfaces and a lower horizontal portion which mate with the configurations forming the recesses 20 in the strip 17 carried by the insole 16. As the marginal strip 32 is formed of flexible material, there is the opening 34 (FIGS. 1 and 2) at the rear, and the strip 32 may be flexed during the removing or securing of the outsole 26 from or to the insole 16 of the upper 10.

As the beads 28 and 30 may be carried by strips 17 as well as by strips 32, and recesses 18 and 20 may be carried by strip 32 as well as by strip 17, it has been stated and claimed that one part of the bead-and-recess mechanical locking means is carried by the upper 10 and the other part thereof is carried by the outsole 26.

The upper surface of the outsole 26 is preferably provided with a plurality of upwardly projecting, longitudinally extending ribs 36 and the insole 16 is provided with mating recesses 22. Also, the upper surface of outsole 26 is preferably provided with a pluraliy of upwardly projecting, crosswise extending ribs 40 (FIG. 2) and the insole 16 is provided with mating recesses 24. Again, obviously, the insole 16 could have the ribs and the outsole 26 could have the grooves.

An additional locking construction employs one part 39 of a Velcro connector carried by the bottom of insole 16 and the mating Velcro connector 41 carried by the upper surface of outsole 26.

At the toe end portion, further additional engaging means is preferably provided to withstand and prevent relative movement between the insole 16 and the outsole 26 and a similar engaging means is preferably provided at the heel portion for the same purpose. Often players drive their toes or heels into the ground to clear away debris from the undersurface of outsole 26. This additional engaging means comprises two sets of detachable connections 44, each set comprising a plurality of projecting shafts with terminal balls and with one set carried by insole 16 and the other set carried by outsole 26. These detachable connectors 44 may be of the type sold by Minnesota Mining & Manufacturing Co.

In the drawings, the upper 10 is illustrated by a low-cut shoe but obviously some players use high-cut shoes and the same are included by reference. Also, laces 46, vent holes 48, heels 50, and reinforcement strips 52 and 54 are included only as illustrations of parts of standard shoes. Also, the tread 56 on the bottom of outsole 26 is only illustrative of the many treads which may be carried by outsole 26.

In installing outsole 26 to upper 10, the toe portion of upper 10 is aligned with the toe portion of outsole 26 and the forward detachable connectors 44, carried by each, are firmly and positively engaged with the flexible strip 32 bent away from strip 17 so as to not interfere. At the same time, caution should be exercised to ensure (1) that the longitudinal ribs 36 and the crosswise ribs 40 of outsole 26 mesh with the grooves 24 and 22 of insole 16 and the vertical strip 32 is properly urged into place with the beads 28 and 30 of the strip 32 properly inserted into the recesses 18 and 20 of the strip 17. As the strip 17 is cut away at opening 34 at the rear, the strip 17 can be properly manipulated to permit the aligning of the various recesses and beas. After such aligning, and after any final adjustment or manipulation, the rearward, detachable connectors 44 are firmly engaged with each other.

RESTATEMENT OF THE INVENTION

From the foregoing, it is now obvious that I have provided a shoe comprising any suitable upper, such as 10. This upper 10 terminates along its peripheral margins in one part of a bead-and-recess mechanical locking means. In other words, either the beads or the recess part thereof may be carried by the upper 10 and as an illustration thereof, recesses 18 and 20 are carried by strip 17 of upper 10.

Next, a removable outsole 26 is shown and a flexible member, such as strip 32 is provided. This strip 32 is illustrated as carried by outsole 26 but again the same could be carried by upper 10. As the recesses 18 and 20 are shown as carried by the upper 10, the strip 32 is shown as carrying beads 28 and 30 which mate with the recesses 18 and 20 and complete the bead-and-recess mechanical locking means between the upper 10 and the outsole 26.

There are a number of additional locking means, which I find necessary for athletic shoes between the upper 10 and outsole 26. One thereof includes the mating parts 39 and 41 of Velcro surfaces, one thereof carried by insole 16 of upper 10 and the other thereof carried by the outsole 26.

The lower surface of the outsole 26 is provided with a cleated pattern 56 to illustrate the many nonskid types of treads which may be provided on the bottom of outsole 26.

The combination of a bead-and-recess mechanical locking means between the upper 10 and the outsole 26, preferably comprises part thereof carried by the insole 16 along a marginal portion thereof and a part thereof carried by the outsole 26 along a marginal portion thereof.

Preferably, the shape of the beads of the mechanical locking means is with some thereof with a horizontal surface and an intersecting surface extending angularly upwardly therefrom and some of which are circular in section.

Longitudinal and crosswise mating tongue-and-groove combinations are carried by the top and bottom abutting surfaces of the outsole 26 and the upper 10 to augment the securance between the two.

Obviously, changes may be made in the forms, dimensions, and arrangements of the parts of my invention without departing from the principle thereof, the above setting forth only preferred forms of embodiment of my invention.

I claim:

1. A shoe comprising an upper; an insole connected with the upper, said insole terminating along its peripheral margins in one part of a longitudinally extending bead and a longitudinally extending and mating recess mechanical locking means, said longitudinally extending bead part comprising beads which are round in section and beads which have a face disposed in a horizontal plane and a face which extends angularly and upwardly therefrom; a removable outsole; and a flexible member connected with said outsole and terminating along its peripheral margins with the other part of the longitudinally extending bead and longitudinally extending recess mechanical locking means.

2. The combination of claim 1, wherein the longitudinally extending recess part of said longitudinally extending bead and longitudinally extending recess mechanical locking means is carried by said insole.

3. The combination of claim 1, wherein one part of an interlocking tongue and groove means is carried by the lower face of said insole and the other part thereof is carried by the upper face of said outsole.

4. The combination of claim 3, wherein the groove part of said interlocking tongue and groove means is carried by the upper face of said outsole.

5. The combination of claim 3, wherein a portion of the tongue-and-groove means carried by the insole is disposed crosswise thereof and a portion thereof is disposed longitudinally and centrally thereof.

6. The combination of claim 1, wherein Velcro detachable securing members are provided, one carried by the outsole and the other carried by the insole.

* * * * *